US010368660B2

(12) United States Patent
Vonberg et al.

(10) Patent No.: US 10,368,660 B2
(45) Date of Patent: Aug. 6, 2019

(54) REFRIGERATED SALES FURNITURE

(71) Applicant: CARRIER CORPORATION, Farmington, CT (US)

(72) Inventors: Andrej Vonberg, Mainz-Kostheim (DE); Markus Fuchs, Mainz-Kostheim (DE)

(73) Assignee: CARRIER CORPORATION, Palm Beach Gardens, FL (US)

( * ) Notice: Subject to any disclaimer, the term of this patent is extended or adjusted under 35 U.S.C. 154(b) by 455 days.

(21) Appl. No.: 14/893,614

(22) PCT Filed: May 29, 2013

(86) PCT No.: PCT/EP2013/061098
§ 371 (c)(1),
(2) Date: Nov. 24, 2015

(87) PCT Pub. No.: WO2014/191034
PCT Pub. Date: Dec. 4, 2014

(65) Prior Publication Data
US 2016/0106232 A1 Apr. 21, 2016

(51) Int. Cl.
*A47F 3/04* (2006.01)
*F25D 23/02* (2006.01)

(52) U.S. Cl.
CPC ..... *A47F 3/0443* (2013.01); *A47F 3/0439* (2013.01); *A47F 3/0447* (2013.01); (Continued)

(58) Field of Classification Search
CPC .... A47F 3/0443; A47F 3/0404; A47F 3/0447; A47F 3/0439; F25D 23/023; F25D 11/02; (Continued)

(56) References Cited

U.S. PATENT DOCUMENTS 2,528,916 A 11/1950 Shreve
3,196,626 A 7/1965 Gabler
(Continued)

FOREIGN PATENT DOCUMENTS

CN 2429045 Y 5/2001
CN 1432779 A 7/2003
(Continued)

OTHER PUBLICATIONS

International Search Report for application PCT/EP2013/061098, dated Dec. 17, 2013, 3 pages.
(Continued)

*Primary Examiner* — Keith M Raymond
*Assistant Examiner* — Kamran Tavakoldavani
(74) *Attorney, Agent, or Firm* — Cantor Colburn LLP

(57) ABSTRACT

A refrigerated sales furniture (2) comprises a base (4) provided at the bottom of the refrigerated sales furniture (2); a goods presentation space (10) comprising a front portion allowing access to the goods presentation space (10) and an opposing rear portion; wherein the goods presentation space (10) includes a bottom area (12) located next to the base (4); and a cold air channel (48) located next to the rear portion of the goods presentation space (10) comprising a lower portion (54) arranged next to the bottom area (12) of the goods presentation space (10) and having an opening (18) fluidly connecting the cold air channel (48) with the bottom area (12) of the goods presentation space (10) for allowing cold air to flow from the lower portion (54) of the cold air channel (48) into the bottom area (12) of the goods presentation space (10). The opening (18) is provided as a single opening (18) extending substantially over the whole height and width of the bottom area (12), respectively.

18 Claims, 6 Drawing Sheets

(52) U.S. Cl.
CPC .... *F25D 23/023* (2013.01); *F25D 2317/0651* (2013.01); *F25D 2317/0664* (2013.01)

(58) Field of Classification Search
CPC .. F25D 19/003; F25D 17/06; F25D 2317/066; F25D 2317/0651; F25D 2317/0664; F25C 1/00
See application file for complete search history.

(56) References Cited

U.S. PATENT DOCUMENTS

| | | | | |
|---|---|---|---|---|
| 4,326,385 | A * | 4/1982 | Ibrahim | A47F 3/0447 62/256 |
| 5,675,983 | A * | 10/1997 | Ibrahim | A47F 3/0408 62/255 |
| 5,755,108 | A | 5/1998 | Ibrahim | |
| 6,722,149 | B1 * | 4/2004 | Saroka | A47F 3/0447 454/193 |
| 2006/0107676 | A1 * | 5/2006 | Fockter | A47F 3/0443 62/246 |

FOREIGN PATENT DOCUMENTS

| | | | |
|---|---|---|---|
| CN | 1475734 | A | 2/2004 |
| CN | 101050906 | A | 10/2007 |
| CN | 102022888 | A | 4/2011 |
| CN | 102287987 | A | 12/2011 |
| CN | 202532800 | U | 11/2012 |
| DE | 1197105 | B | 7/1965 |
| WO | 2013029686 | A1 | 9/2011 |

OTHER PUBLICATIONS

Chinese First Office Action and Search Report for application CN 201380077241.X, dated Aug. 22, 2018, 13 pages.

* cited by examiner

REFRIGERATED SALES FURNITURE

The invention relates to a refrigerated sales furniture.

Refrigerated sales furnitures of the front access type allowing for horizontal front access to the goods over almost their entire height are known in the state of the art.

An example of such a front access type refrigerated sales furniture is known from WO 2013/029686 comprising a cooling air channel in the back of the furniture. In said furniture a perforated wall delimits the cooling air channel from the goods presentation space allowing cooling air to flow from the cooling air channel into the goods presentation space.

The flow of cooling air, which results from the structure disclosed by WO 2013/029686, is effective but also very complex and the structure is material and cost expensive.

Accordingly, it would be beneficial to provide a refrigerated sales furniture having a simpler but similarly effective structure, which in particular needs less material and may be produced at lower costs.

This object is attained by the subject-matter of independent claim 1, advantageous embodiments are defined by the dependent claims.

A refrigerated sales furniture according to an exemplary embodiment of the invention comprises a base provided at the bottom of the refrigerated sales furniture and a goods presentation space having a front portion allowing access to the goods presentation space and an opposing rear portion. The goods presentation space includes a bottom area located next to the base and a cold air channel, which is located next to the rear portion of the goods presentation space and comprises an upper portion, a middle portion and a lower portion, the latter being arranged next to the bottom area of the goods presentation space. The lower portion of the cold air channel comprises an opening fluidly connecting the cold air channel with the bottom area of the goods presentation space for allowing cold air to flow from the lower portion of the cold air channel into the bottom area of the goods presentation space. The opening is provided as a continuous opening extending substantially over the whole height and width of the bottom area, respectively.

Exemplary embodiments of the invention are described in greater detail below with reference to the figure, wherein.

Figure 3A:
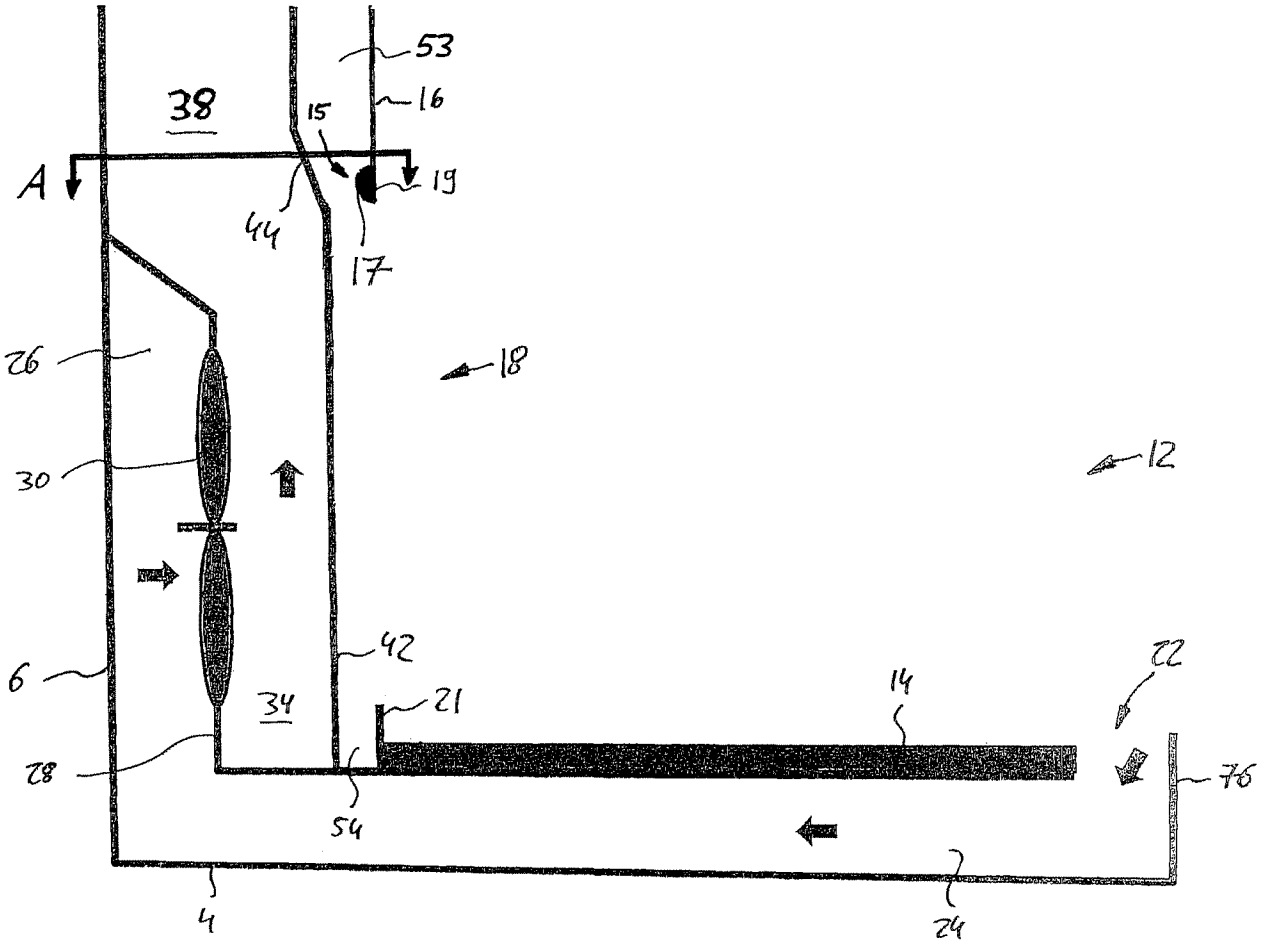
Figure 3C:
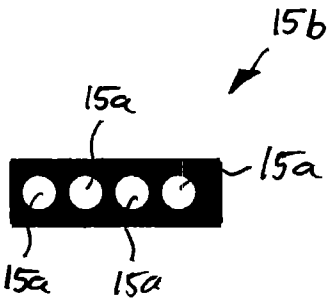
Figure 3B:
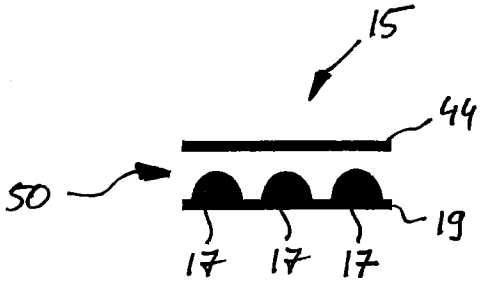

FIGS. 3*a*, 3*b*, 3*c* show embodiments of a nozzle or orifice in a sectional side view and a plane view, respectively.

Figures 4A, 4B:
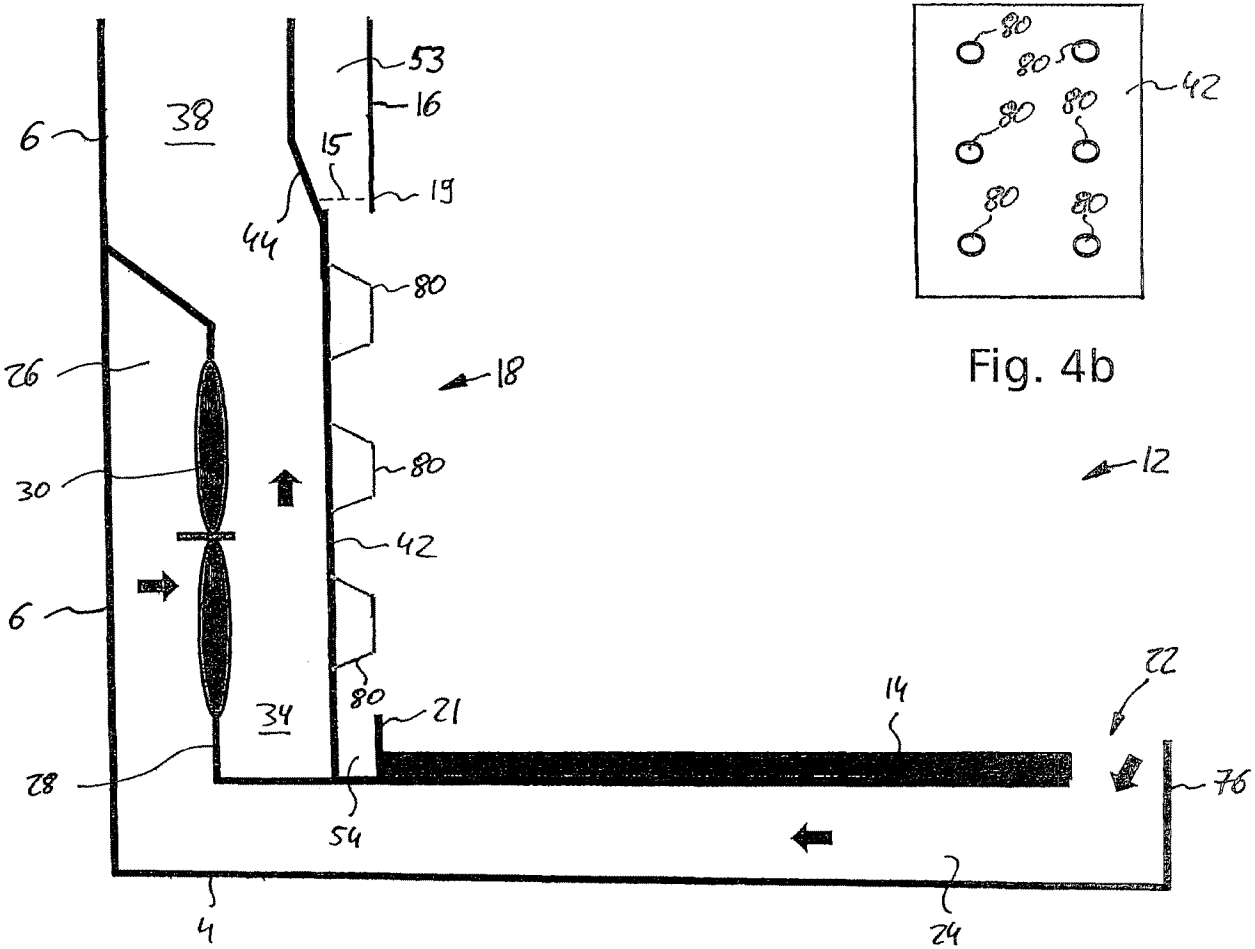

FIGS. 4*a*, 4*b* show a first exemplary embodiment of stopper elements provided in a refrigerated sales furniture according to an embodiment of the invention in a sectional side view and a plane view, respectively.

Figure 5B:
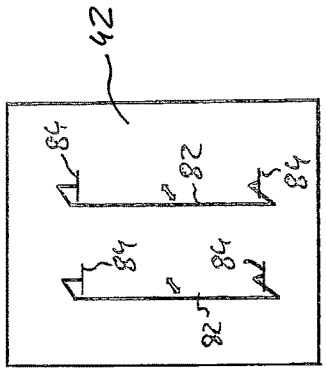
Figure 5A:
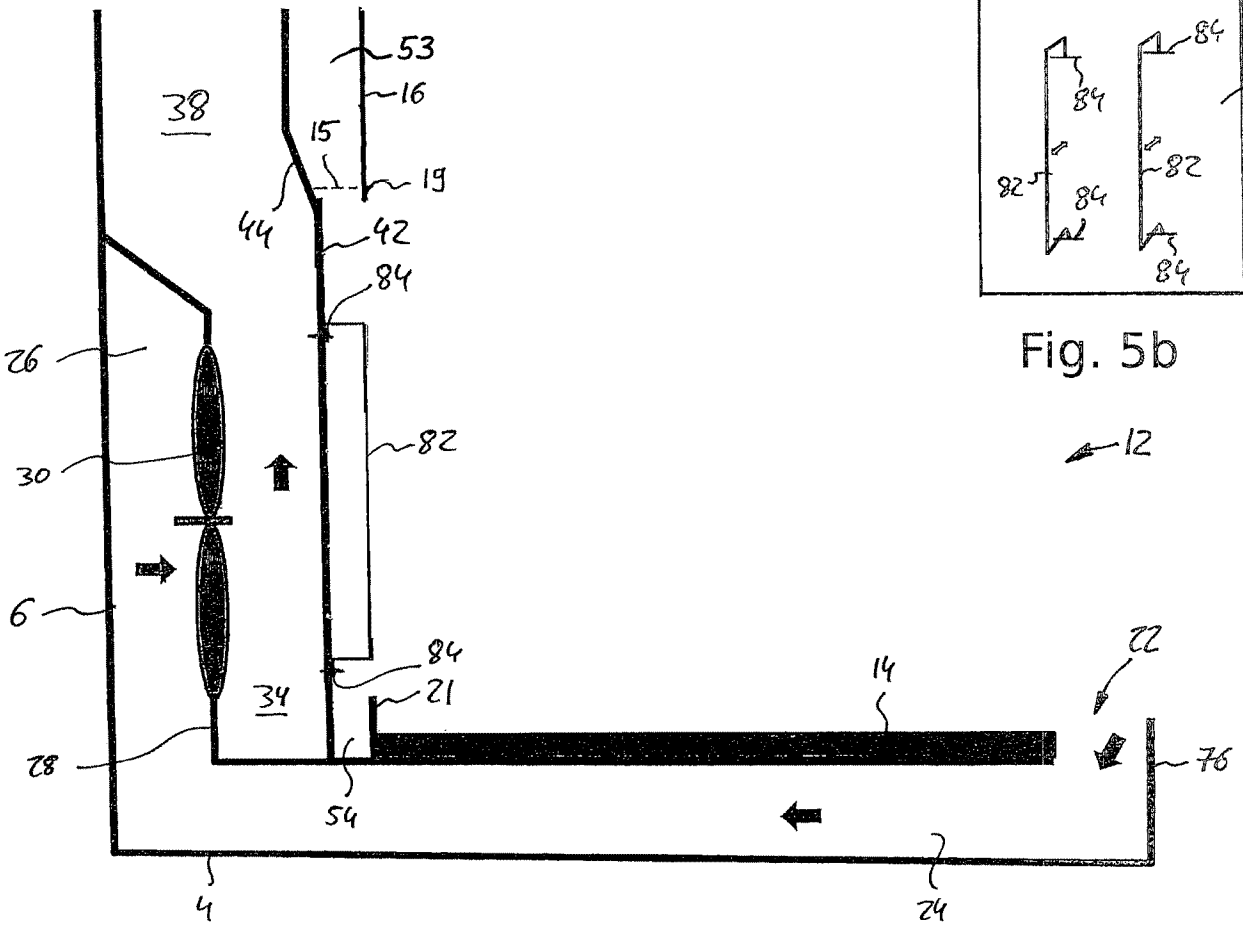

FIGS. 5*a*, 5*b* show a second exemplary embodiment of stopper elements provided in a refrigerated sales furniture according to an embodiment of the invention in a sectional side view and a plane view, respectively.

Figure 1:
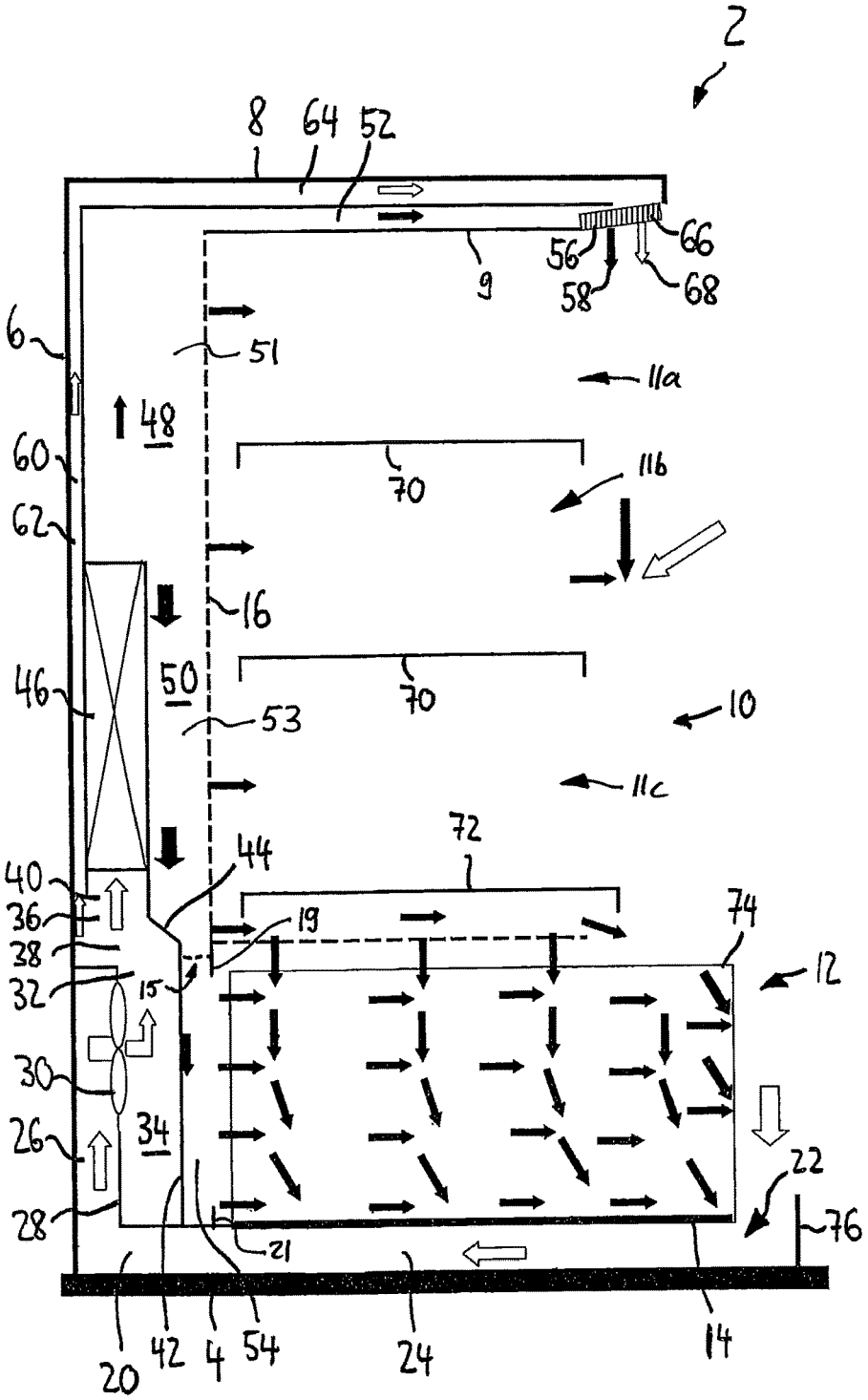
FIG. 1 shows a schematic side view of a refrigerated sales furniture according to an embodiment of the invention.

FIG. 1 shows a schematic side view of a refrigerated sales furniture 2 according to an embodiment of the invention, with the side wall/side cover removed in order to provide an unobstructed view into the refrigerated sales furniture 2.

The refrigerated sales furniture 2 shown in FIG. 1 is of the front access type and is also called refrigerated sales cabinet. The refrigerated sales furniture 2 allows a customer (not shown) standing in front (in FIG. 1 to the right) of the refrigerated sales furniture 2 to access the goods presented in a goods presentation space 10 substantially horizontally over almost the entire height of the refrigerated sales furniture 2. This maximizes the available goods presentation space 10 and meets the retail and wholesale demands.

The refrigerated sales furnitures 2 described herein can be operated at normal cooling temperatures of above 0° C. and at freezing temperatures of below 0° C.

In one embodiment, the refrigerated sales furniture 2 can be of the open front access type without front access doors, as described with respect to FIG. 1. In particular, the refrigerated sales furnitures 2 described herein can be of such kind and/or can be operated to provide for such cooling temperatures at the evaporator(s) and such air temperatures of the air flowing within the goods presentation space that the lowest temperature commonly achievable for products within the goods presentation space is −1° C.

Although the refrigerated sales furniture 2 of FIG. 1 is open at its front access side, it also may be equipped with sliding or pivoting doors at its front access side that have to be opened in order to get access to the goods presentation space 10.

The refrigerated sales furniture 2 shown in FIG. 1 comprises a horizontal base 4 that can be provided with stands (not shown), an upright furniture rear wall 6 extending from the rear end of the base 4 that is typically positioned in front of a building wall, and an upper furniture wall 8. The base 4, the furniture rear wall 6 and the upper furniture wall 8 together with the side walls (not shown) confine the interior space of the refrigerated sales furniture 2.

The interior of the refrigerated sales furniture 2 comprises the goods presentation space 10, which is confined by a goods presentation space bottom wall 14, by a partially perforated goods presentation space rear wall 16 and by an upper goods presentation space wall 9, as well as air channels 20, 32, 48, 60, a fan 30 and an evaporator 46 that are at least partly located outside of the goods presentation space 10. The air channels 20, 32, 48, 60, the fan 30 and the evaporator 46 are arranged between the furniture rear wall 6 and the partially perforated goods presentation space rear wall 16. A substantially horizontal portion 24 of an air suction channel 20 is arranged between the base 4 and the goods presentation space bottom wall 14 and substantially horizontal channel portions 52 and 64 of a cold air channel 48 and a warm air channel 60 extend between the upper goods presentation space wall and the upper furniture wall 8.

In the exemplary embodiment shown in FIG. 1, there are depicted three goods presentation shelves 70, 72 that may be fastened by appropriate means to the partially perforated goods presentation space rear wall 16 and the goods presentation space side walls (not shown). The goods presentation shelves 70, 72 extend substantially horizontally and are configured to carrying the goods (not shown) to be presented and sold.

Although three goods presentation shelves 70, 72 are shown in FIG. 1, any suitable number of goods presentation shelves may be provided within the goods presentation space 10.

The lowermost of the three goods presentation shelves 70, 72 may be formed as an air guiding goods presentation shelf 72. Cold air from the cold air channel 48 (to be described later) flows into the interior of such air guiding goods presentation shelf 72 and is directed through appropriate openings at the underside of such shelf 72 in a substantially vertical direction to the goods compartment lying underneath such air guiding goods presentation shelf 72, which is in the embodiment of FIG. 1 the bottom area 12 of the goods presentation space 10. By such air guiding goods presentation shelves 72, an efficient cooling of the goods positioned in the compartment underneath can be attained. Such an air guiding goods presentation shelf 72 is not necessarily needed for the functionality of the invention, as the flow of cold air from the lower portion 54 of the cold air channel into the bottom area 12 of the goods presentation space 10 will be sufficient. The use of such an air guiding goods presentation shelf 72 in combination with the invention, however, is possible.

Between the front end of the goods presentation space bottom wall 14 and the lower front portion of the refrigerated sales furniture 2, that can be provided with a removable bumper 76, there is an air entry opening 22 of an air suction channel 20, into which relatively warm ambient and/or return air enters and is conveyed through a substantially horizontal air suction channel portion 24 arranged between the base 4 and the goods presentation space bottom wall 14 and through a substantially vertical rear air suction channel portion 26 that is arranged at a position behind the bottom area 12 of the goods presentation space 10 and arranged adjacent to and substantially in parallel to the furniture rear wall 6 and to a fan 30 sucking the relatively warm air through such air suction channel 20 and pushing it through an air pressure channel 32, through an evaporator 46, through a cold air channel 48 and through the partially perforated goods presentation space rear wall 16 into the goods presentation space 10.

The size of the fan 30 as it is shown in the figures is only of exemplary kind, and fans 30 of any kind may be used as long as their width is sufficient to fit into the space which is available between the rear air suction channel portion 26 and the lower air pressure channel portion 34.

The substantially vertical rear air suction channel portion 26 is separated from a lower air pressure channel portion 34 of the air pressure channel 32 by means of a vertical wall 28, and in the present embodiment the vertical rear air suction channel portion 26 ends at a height corresponding substantially to the height of the bottom area 12 of the goods presentation space 10. However, there is no functional relationship between the height of the bottom area 12 and the substantially vertical rear air suction channel portion 26, and consequently the vertical wall 28 may also end at another position of height. The fan 30 is arranged in an appropriate opening of such vertical wall 28, and it is driven by an electric motor (not shown) that may be at least partly arranged within the substantially vertical rear air suction channel portion 26.

The air pressure channel 32 comprises a lower air pressure channel portion 34, that extends in front of and substantially in parallel to the rear air suction channel portion 26 of the air suction channel 20, and an upper air pressure channel portion 36 having a greater width than the lower air pressure channel portion 34, the upper air pressure channel portion 36 extending between the furniture rear wall 4 and the cold air channel 48. In other words, in the present embodiment the lower air pressure channel portion 34 extends between the rear air suction channel portion 26 and a lower cold air channel portion 54 of the cold air channel 48 (to be described later) up to a height where the rear air suction channel portion 26 ends, which corresponds to the height of the bottom area 12 of the goods presentation space 10. The rear air suction channel portion 26 is that high that the fan 30 can be accommodated therein with its entire height, and consequently the minimum height of the vertical rear air suction channel portion 26 depends on the height (diameter) of the fan 30. It is understood, that it is possible that the refrigerated sales furniture 2 comprises a plurality of fans 30.

The upper air pressure channel portion 36 extends from the position of height, where the rear air suction channel portion 26 ends, up to a position of height corresponding to the lower end of the evaporator 46, and it is confined on the rear side by the furniture rear wall 6 and on the front side by the cold air channel 48.

The vertical wall 42 that separates the air pressure channel 32 from the cold air channel 48 makes a bend 44 approximately at a middle portion of the height of the upper air pressure channel portion 36, in particular a bent 44 to the back so as to define a reduced width upper section 40 of the upper air pressure channel portion 36 and a higher width lower section 38 of the upper air pressure channel portion 36. At the upper end of the reduced width upper section 40 of the upper air pressure channel portion 36 there is an entry side of a warm air channel 60, in particular a vertical warm air channel portion 62, and an evaporator 46, in particular an entry side of an evaporator 46. The vertical wall 42 may be provided with a thermal insulation in order to thermally insulate the cold and warm flows flowing on both sides of said vertical wall 42.

The height and the shape of the vertical wall 42 are described in detail with respect to the non-limiting embodiment of FIG. 1. It is understood that the vertical wall can have another height and another shape as well.

Likewise, the position and the height of the fan 30, of the channel portions 26, 34 and 54, and of the bottom area 12, are described in detail with respect to the non-limiting embodiment of FIG. 1. It is understood that other dimensions are possible, too.

The warm air channel 60 extends from the position of height corresponding to the entry side of the evaporator 46 along the furniture rear wall 6 and the upper furniture wall 8 to a warm air curtain opening 66, which can be a honeycomb, that is positioned at the front of the upper furniture wall 8, and it comprises a substantially vertical warm air channel portion 60 and a horizontal warm air channel portion 62. The partial air flow flowing through the warm air channel 60 is not cooled by the evaporator 46. Such warm air exits the warm air channel 60 through the warm air opening 66 and forms a curtain of warm air 68 in front of the goods presentation space 10 extending between the warm air curtain opening 66 and the air entry opening 22 of the air suction channel 20.

The evaporator 46 is of relatively small width and it is positioned in the intermediate space between the front side of the vertical warm air channel portion 62 and the partially perforated goods presentation space wall 16 and leaves enough free space in front of the evaporator 46 so as to form a substantially vertical cold air channel portion 50. The evaporator 46 is part of a refrigeration cycle comprising at least a compressor, a condenser, an expansion device, the evaporator 46 and refrigerant conduits connecting these elements serially so as to form a closed refrigeration cycle as it is known in the art. The other elements of such refrigeration cycle except for the evaporator 46 are not shown in FIG. 1.

The partial air flow flowing through the evaporator 46 is cooled in the evaporator 46 in heat exchange against a refrigerant circulating in a refrigeration cycle and having been expanded by means of the expansion device before entering the evaporator 46. The air exiting the evaporator 46 from its upper outlet side is called cold discharge air, and it leaves the cold air channel 48 from which it is supplied as cooling air flow to the goods presentation space 10 from the back through the perforated goods presentation space rear wall 16 and as cold air curtain flow to an air curtain opening 56 positioned at the front of the upper furniture wall 8 adjacent to and immediately behind the warm air curtain opening 66 so as to form a curtain of cold air 58 flowing from the cold air curtain opening 56 along the front side of the goods presentation space 10 to the air entry opening 22 of the air suction channel 20. The curtain of cold air 58 is formed behind the curtain of warm air 68, which combination has been shown as particularly effective for minimizing the amount of warm air entering into the goods presentation space 10 from the front.

The cold air channel 48 comprises a substantially vertical cold air channel portion 50 extending over the entire height of the goods presentation space 10, and a horizontal cold air channel portion 52 being positioned underneath the horizontal warm air channel portion 64, the lower wall of which also forms the upper goods presentation space wall.

The substantially vertical cold air channel portion 50 comprises three portions 51, 53, 54 of different widths, namely an upper portion 51 of greater width extending between the upper outlet side of the evaporator 46 and the lower wall of the horizontal warm air channel portion 64, a middle portion 53 of medium-sized width extending between the level of height where the vertical wall 42 makes a bend 44 to the back and the level of height corresponding to the upper outlet side of the evaporator 46, and a lower cold air channel portion 54 of smaller width extending between the goods presentation space bottom wall 14 and a level of height where the vertical wall 42 makes a bend 44 to the back.

The width of the upper portion 51 corresponds to the width between the furniture rear wall 6 and the partially perforated goods presentation space rear wall 16 minus the width of the vertical warm air channel portion 62. The width of the middle portion 53 corresponds to the width between the furniture rear wall 6 and the partially perforated goods presentation space rear wall 16 minus the width of the evaporator 46 and minus the width of the vertical warm air channel portion 62. The width of the lower cold air channel portion 54 corresponds to the width between the furniture rear wall 6 and the partially perforated goods presentation space rear wall 16 minus the width of the substantially vertically rear air suction channel portion 26 and minus the width of the lower air pressure channel portion 34.

By means of the substantially vertical cold air channel portion 50 cold air may be supplied from the back through a perforated portion of the goods presentation space rear wall 16 to the upper and middle areas 11*a*, 11*b*, 11*c* of the goods presentation space 10 providing for an efficient cooling of said areas 11*a*, 11*b*, 11*c*.

In the goods compartments in the middle and the upper areas 11*a*, 11*b*, 11*c* of the goods presentation space 10, in particular in the goods compartments 11*a*, 11*b*, 11*c* arranged over the three goods presentation shelves 70, 72 shown in FIG. 1, a horizontal cold airflow provided through the plurality of openings provided in the perforated rear wall 16 is present.

Furthermore, by means of the air guiding goods presentation shelf 72 arranged above the bottom area 12 of the goods presentation space 10, cold air exiting from the middle portion 53 of the cold air channel 48, entering the air guiding goods presentation shelf 72 and exiting the same through openings in its bottom enters from above in a downward direction into the bottom area/base compartment 12. This substantially vertical airflow in downward direction is schematically depicted by vertical arrows, and it can be seen that by the combination of cold air entering from the lower portion 54 of the cold air channel 48 in a horizontal direction and cold air entering from above in a substantially downward direction, a very efficient matrix cooling can be attained.

The airflow flowing down from the air guiding goods presentation shelf 72 is diverted on its way to the goods presentation space bottom wall 14 in a forward direction by means of the horizontal airflow coming from the back so that the horizontal and the downwardly directed vertical airflows mix. After having flown through the bottom area 12, the air has warmed up in heat exchange against the goods to be sold positioned in the bottom area 12 and such airflow enters the air entry opening 22 together with the airflows coming from above, in particular the cold air and warm air curtains 58 and 68.

As a matter of cause, also the other goods presentation shelves 70 can be formed as air guiding goods presentation shelves 72 so as to enable an airflow from above in a downward direction to the upper and middle areas 11*a*, 11*b*, 11*c* of the goods presentation space 10 respectively arranged underneath the air guiding goods presentation shelves 72.

At the front side of the goods presentation space 10, the curtain of cold air 58, the cold air flow coming from the back and the warm air flow coming from the front are depicted schematically by arrows.

Figure 2:
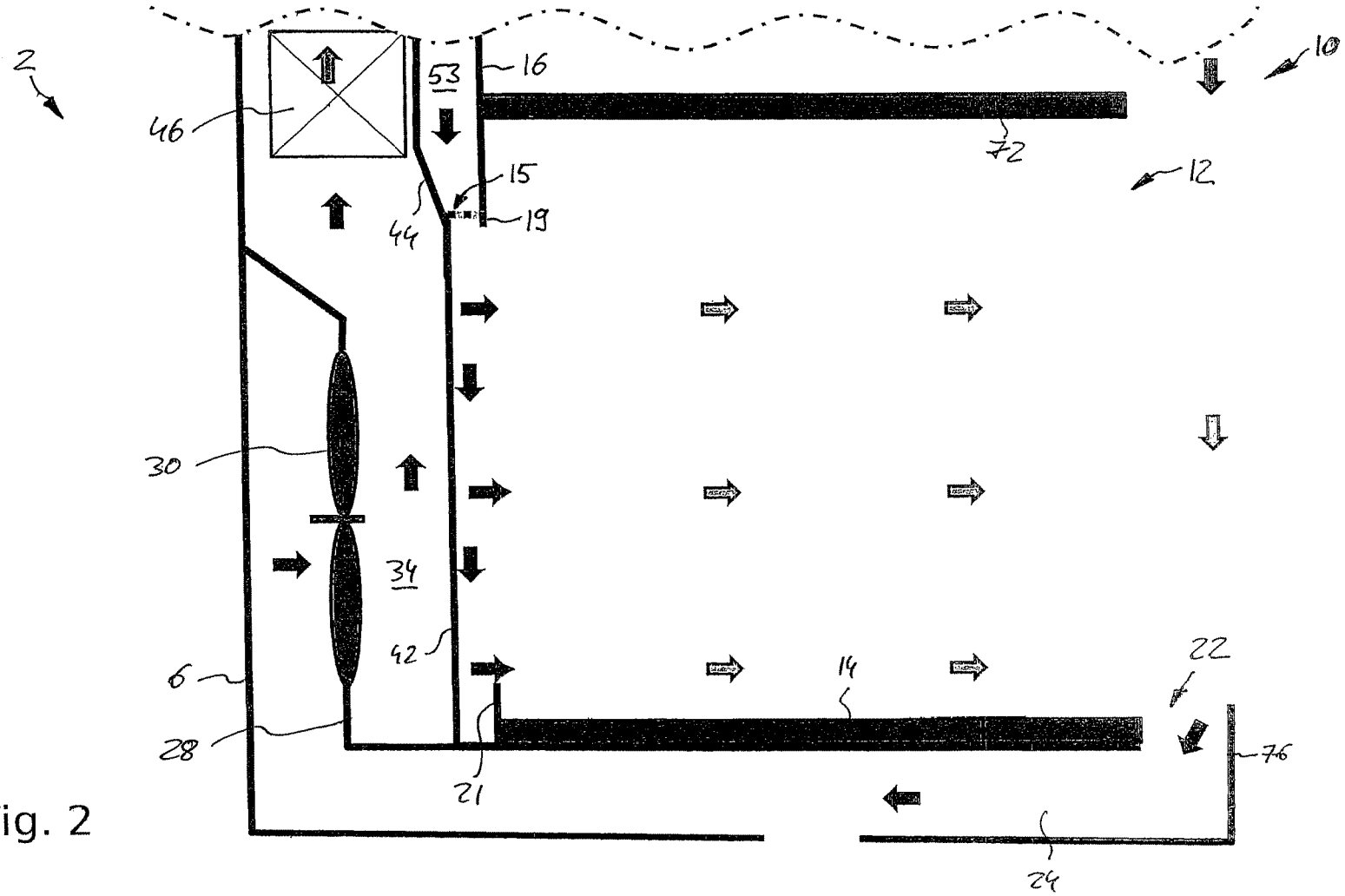
FIG. 2 shows an enlarged version of the bottom portion of the refrigerated sales furniture shown in FIG. 2.

An enlarged version of the bottom area 12 of the refrigerated sales furniture 2 is shown in FIG. 2.

As can be seen in FIGS. 1 and 2, a continuous opening 18 basically extending over the whole width and height of the bottom area 12 of the goods presentation space 10 may be formed within a lower portion of the rear wall 16 located at the back of the bottom area 12. Said continuous opening 18 allows to supply cold air from the lower portion 54 of the cold air channel 48 into the bottom area 12 of the goods presentation space 10, as it is depicted by means of the horizontal arrows shown in FIGS. 1 and 2.

Alternatively, the rear wall 16 may extend only upwards from a height located in an upper portion of the bottom area 12 of the goods presentation space 10 leaving most of the height of the lower portion 54 of the cold air channel 48 completely open to the bottom area 12 of the goods presentation space 10, allowing to supply cold air from the lower portion 54 of the cold air channel 48 into the bottom area 12 of the goods presentation space 10.

An air baffle element 19 formed e.g. as an air baffle strip extends downwardly in extension of the at least partially perforated rear wall 16 located at the upper edge of the opening 18 in order to guide and direct the flow of cold air exiting from the middle portion 53 of the cold air channel 48 in a basically vertical direction in order to ensure that a sufficient portion of said flow of cold air reaches the bottom of the lower portion 54 of the cold air channel 48 arranged adjacent to the bottom area 12 of the goods presentation space 10.

Additionally or alternatively a nozzle or an orifice 15 usually extending over the whole width of the middle portion 53 of the cold air channel 48 is arranged at a height above the opening 18 in order to appropriately form the flow of cold air flowing from the middle portion 53 of the I cold air channel 48 into the lower portion 54 of the cold air channel 48 and into the bottom area 12 of the goods presentation space 10. The nozzle or an orifice 15 further allows to control the amount of air flowing into the lower portion 54 of the cold air channel 48 and into the bottom area 12 of the goods presentation space 10. The nozzle or orifice 15 in particular may be provided in the area of the bent 44 of the vertical rear wall 42.

FIGS. 3*a*, 3*b*, 3*c* respectively show embodiments of a nozzle or orifice 15 in a sectional side view (FIG. 3*a*) and a plane view (FIGS. 3*b*, 3*c*) along plane A shown in FIG. 3*a* in a schematic view.

In a first embodiment shown in FIGS. 3*a* and 3*b*, the nozzle or orifice 15 is formed by one or more protrusions 17, projecting from one or both walls 16, 42 defining the middle portion 53 of the cold air channel 48. Such protrusions 17 may be formed conveniently at low costs by stamping or moulding the (metal) sheets forming the walls 16, 42. Alternatively or additionally at least one protruding element 17 may be attached, e.g. welded, fused or glued, to at least one of said walls 16, 42.

Alternatively the nozzle or orifice 15 may be formed by an insert element 15*b*, which is inserted into the middle portion 53 of the cold air channel 48 and extends basically perpendicularly to the direction of the flow of cold air within said middle portion 53 of the cold air channel 48. The insert element 15*b* comprises at least one opening 15*a*, in particular a plurality of openings 15*a*, allowing the cold air to pass the insert element 15*b* in a well-defined manner. The amount, form and direction of the flow of cold air passing the insert element 15*b* may be adjusted by the number and the form of the openings 15*a* provided within the insert element 15*b*.

The middle portion 53 of the cold air channel 48 and the insert element 15*b* may be configured so that the insert element 15*b* is exchangeable allowing to adjust the flow of cold air exiting from the middle portion 53 into the lower portion 54 of the cold air channel 48 and into the bottom area 12 of the goods presentation space 10 according to the actual needs by introducing an appropriate insert element 15*b*. A removable insert element 15*b* also facilitates the cleaning and maintenance of the refrigerated sales furniture 2 and in particular of the substantially vertical cold air channel portion 50.

At least one stopper element 21 is provided at the goods presentation space bottom wall 14. The at least one stopper element 21 is configured for preventing goods from the bottom areas 12 of the goods presentation space 10 from entering into the lower portion 54 of the cold air channel 48 and blocking the flow within said lower portion 54. The stopper element 21 may be a single stopper element 21, which may extend basically over the whole width and/or the height of the opening 18. Alternatively, a plurality of stopper elements 21, which are spaced apart from each other, may be arranged along the width and/or the height of the opening 18.

In further embodiments the stopper element(s) 21 may be fixed to the vertical rear wall 42 of the cold air channel 50, 54.

FIGS. 4*a*, 4*b* and 5*a*, 5*b* respectively show exemplary embodiments of such stopper elements 88, 82 in a sectional side view (FIGS. 4*a*, 5*a*) and a plane view (FIGS. 4*b*, 5*b*).

In a first embodiment shown in FIGS. 4*a* and 4*b*, the stopper elements 80 are formed as protrusions or stampings projecting from the vertical rear wall 42 of the lower portion 54 of the cold air channel 48 in the direction of the bottom area 12 of the goods presentation space 10 thereby preventing goods from entering from the bottom area 12 into the lower portion 54 of the cold air channel 48. The projecting stopper elements 80 are spaced apart from each other in the horizontal direction in order to allow cold air to flow in basically vertical direction through the lower portion 54 of the cold air channel 48 between the stopper elements 80. Stopper elements 80 projecting as protrusions or stampings from the vertical rear wall 42 of the lower portion 54 of the cold air channel 48 are very robust and may be produced conveniently at low costs by stamping and/or moulding the metal sheet material forming the vertical rear wall 42 of the lower portion 54 of the cold air channel 48.

In a second embodiment shown in FIGS. 5*a* and 5*b*, the stopper elements 82 are provided in the form of spacer rods 82 secured to corresponding links 84 which are provided at the rear wall 42 of the lower portion 54 of the cold air channel 48. The spacer rods 82 again prevent goods from entering into the lower portion 54 of the cold air channel 48. The spacer rods 82 are spaced apart from each other in the horizontal direction in order to allow cold air to flow in basically vertical direction through the lower portion 54 of the cold air channel 48 between the spacer rods 82. In an embodiment the spacer rods 82 and the links 84 are formed so that the spacer rods 82 may be removed easily from the links 84 for maintenance and/or cleaning purposes.

Instead of or additionally to the stopper element(s) 21 at least one marker element 21 may be provided at the goods presentation space bottom wall 14 and/or on the sidewalls (not shown) of the bottom area 12 of the goods presentation space 10 in order to mark the boundary between the goods presentation space 10 and the cold air channel 48 and in particular its lower portion 54. Said marker element(s) 21 indicate(s) that no goods may be stored beyond said boundary as those goods would obstruct the flow of cold air within the lower portion 54 of the cold air channel 48 deteriorating the cooling capabilities of the refrigerated sales furniture 2.

Additionally or alternatively, at least one detecting element 21, i.e. a mechanical contactor and/or a light barrier using infrared or visible light may be arranged at the boundary between the goods presentation space 10 and the lower portion 54 of the cold air channel 48 in order to detect when goods are moved from the goods presentation space 10 beyond said boundary into the lower portion 54. In case the detecting element(s) 21 detect(s) the presence of any goods within the lower portion 54 of the cold air channel 48 an acoustical and/or an optical signal may be triggered in order to notify the personal in charge of the refrigerated sales furniture 2 in order to remove said goods from the lower portion 54 of the cold air channel 48 for allowing an unobstructed flow of cold air within the lower portion 54 of the cold air channel 48 and into the bottom area 12 of the goods presentation space 10.

A refrigerated sales furniture according to exemplary embodiments of the invention, as it is described herein, provides an efficient air-flow guidance in particular into the lower portion of the goods presentation space, which is achieved with few material at low costs, as it does not comprise a perforated rear wall in the bottom area of the goods presentation space. Thus, the material and costs for manufacturing said perforated wall, as well as the efforts for installing, and, in the case of maintenance, removing, of said perforated wall may be saved.

A refrigerated sales furniture according to exemplary embodiments of the invention, as it is described herein, provides for a maximized goods presentation space extending from a very low level of height to a very high level of height within the refrigerated sales furniture, while at the same time an efficient cooling of the entire goods presentation space and in particular of the critical bottom area/base compartment is ensured.

By conveying cold air through the opening provided in the lower portion of the cold air channel to the bottom area of the goods presentation space and by optionally directing cold air from the cold air channel through the bottom of the air guiding goods presentation shelf to the bottom area of the goods presentation space, a stable and consistent matrix air flow through the bottom area of the goods presentation space is ensured.

The opening in the lower portion of the cold air channel may be provided as an opening formed in a lower portion of the rear wall next to the bottom area of the goods presentation space.

Alternatively, the rear wall may extend only upwards from a position of height at an upper portion of the bottom area of the goods presentation space leaving most of the height of the lower portion of the cold air channel open to the bottom area of the goods presentation space, allowing cold air to flow from the lower portion of the cold air channel into the bottom area of the goods presentation space.

It is advantageous that the fan which is typically quite space-consuming is arranged behind the bottom area of the refrigerated sales furniture. This provides for a refrigerated sales furniture where the entire height can be used for presenting goods to be sold, which meets the demand for a maximized available space for presenting goods to be sold. With the configuration of the exemplary embodiments as described herein. a horizontal cold air flow can be led into the bottom area/base compartment from the back, which ensures an efficient cooling of the entire goods presentation space and in particular of the critical bottom area/base compartment.

The space available behind the lower rear wall portion of the goods presentation space rear wall can be sufficient for arranging the rear air suction channel portion of the air suction channel, the lower air pressure channel portion of the air pressure channel and the lower cold air channel portion of the cold air channel behind it provided that the width of these channel portions are optimized.

Especially in combination with the air guiding goods presentation shelf arranged directly above the bottom area/base compartment, a stable and consistent matrix airflow through the bottom area/base compartment can be provided.

In a refrigerated sales furniture according to exemplary embodiments of the invention lower temperatures of goods stored within the base compartment of the refrigerated sales cabinet can be reached, in particular those lower temperatures correspond to the discharge air temperature.

Further the amount of circulating air can be reduced, since the base compartment gets flown through by cold air directly.

The energy consumption of the refrigerated sales furniture can be reduced because of the advantages as described herein. Moreover, a better temperature performance can be attained, because the air curtain within the base compartment is made more stable even when goods are partly sold.

In an embodiment, the bottom area extends substantially between the base of the refrigerated sales furniture and a goods presentation shelf located on top of the bottom area. The goods presentation shelf located on top of the bottom area delimits the bottom area and helps to guide and keep the cold air within the bottom area.

In an embodiment, the cold air channel is defined by a front wall and a rear wall, the front wall of the cold air channel forming a rear wall of the goods presentation space providing a robust and material saving structure.

In an embodiment, the front wall of the cold air channel is perforated in an area above the bottom area allowing cold air to flow from the cold air channel into middle and upper portions of the goods presentation space. This allows to cool goods stored in the middle and upper portions of the goods presentation space as well.

In an embodiment, the refrigerated sales furniture further comprises a baffle element for guiding and/or controlling the cold air flowing in the cold air channel in order to provide an effective flow of cold air into the bottom area of the goods presentation space supplying a sufficient amount of cold air to all regions of the bottom area.

In an embodiment, the baffle element comprises a baffle strip arranged at an upper portion of the bottom area of the goods presentation space next to the cold air channel. Such a baffle strip provides an effective but cheap and robust baffle element.

In an embodiment, the baffle element is configured for guiding the flow of cold air exiting of the cold air channel into the bottom area of the goods presentation space downwardly in order to ensure that a sufficient portion of the flow of cold air reaches every portion of the bottom area of the goods presentation space.

In an embodiment the baffle element extends over the whole width of the opening in order to provide a very effective baffle element.

In an embodiment the refrigerated sales furniture comprises a nozzle or an orifice which is configured for guiding the cold air flowing within the cold air channel in order to provide a flow of cold air which effectively cools the goods stored in the goods presentation space and in particular reaches any region of the bottom area of the goods presentation space.

In an embodiment the cross section of the cold air channel is narrowed in the direction of the flow of cold air on top of the opening in order to provide a nozzle or orifice, respectively.

In an embodiment at least one stopper element is provided at the boundary between the cold air channel and the goods presentation space. The at least one stopper element is configured and provided for preventing goods from the goods presentation space from entering into the cold air channel and blocking the flow of cold air within said cold air channel, which would deteriorate the cooling of the bottom area of the goods presentation space.

In an embodiment at least one stopper element is mounted to or formed by a portion of the rear wall of the cold air channel. Mounting the stopper element to or forming the stopper element from a portion of the rear wall of the cold air channel provides a convenient way of providing the stopper element at low costs. Alternatively or additionally the at least one stopper element may be mounted to or formed by a portion of the goods presentation space bottom wall.

In an embodiment at least one marking element is provided at the boundary between the cold air channel and the goods presentation space. The at least one marking element, which may be provided in the form of a sticker comprising a pictogram, is configured and provided for indicating the boundary between the cold air channel and the goods presentation space in order to prevent that goods from the goods presentation space are moved into the cold air channel blocking the flow of cold air within said cold air channel, which would deteriorate the cooling of the bottom area of the goods presentation space.

In an embodiment at least one detecting element is provided at the boundary between the cold air channel and the goods presentation space. The at least one detecting element is configured for issuing a signal when goods have been moved from the goods presentation space into the cold air channel blocking the flow of cold air within said cold air channel, as blocking the flow of cold air flowing within the cold air channel deteriorates the cooling of the bottom area of the goods presentation space.

The detecting element may comprise a light barrier and/or a mechanical contactor.

In an embodiment an air pressure channel comprising at least on heat-exchanger is provided next to the cold air channel opposite to the goods presentation space in order to provide a refrigerated sales furniture having a compact structure.

In an embodiment the refrigerated sales furniture further comprises an air suction channel for sucking air from a lower front end portion of the refrigerated sales furniture. The air suction channel has a rear air suction channel portion being arranged at a position behind the bottom area of the goods presentation space and arranged between a furniture rear wall and a lower portion of the air pressure channel. This provides a refrigerated sales furniture having a compact structure.

In an embodiment the refrigerated sales furniture further comprises a fan which is configured for delivering air from the air suction channel into the air duct in order to enhance the cooling capacity of the refrigerated sales furniture.

If the term "the fan" or "a fan" is mentioned within this description and within this claims, this term should be construed to also comprise more than one fan and particularly any appropriate number of fans.

According to an embodiment, the fan is arranged in an opening of a vertical wall separating the rear air suction channel portion of the air suction channel from the lower air pressure channel portion of the air pressure channel. By such arrangement of the fan the available space can be used in a very efficient manner.

According to a further embodiment, the fan is configured to rotate around a substantially horizontal axis. Such fan sucks the air very efficiently from the air entry opening at the front portion of the bottom area and blows the air efficiently through the channels and the evaporator and the perforated goods presentation space rear wall located downstream thereof into the goods presentation space.

According to a further embodiment, the air suction channel has an air entry opening at a front portion of the bottom area, and a substantially horizontal air suction channel portion extending between the base of the refrigerated sales furniture and a goods presentation space bottom wall. By such air suction channel the warm return air can effectively be drawn off from the goods presentation space.

According to a further embodiment, the rear air suction channel portion ends at a height corresponding substantially to the height of the bottom area of the goods presentation space. By such air suction channel portion of optimized height a compact arrangement can be ensured.

According to a further embodiment, the air pressure channel has an upper air pressure channel portion of greater width than the lower air pressure channel portion, the upper air pressure channel portion extending between the furniture rear wall and the cold air channel. By such air suction channel, the air can be blown effectively back into the goods presentation space.

According to a further embodiment, the wall separating the upper air pressure channel portion from the cold air channel makes a bend so as to define a reduced width upper section of the upper air pressure channel portion. By such reduced width upper section of the upper air pressure channel portion the occupied space in the middle rear portion of the refrigerated sales furniture is minimized and the channel width of the cold air channel is maximized.

According to a further embodiment, the cold air channel comprises a substantially vertical cold air channel portion and a horizontal cold air channel portion for conveying cold air to the front side of the top portion of the refrigerated sales furniture. By such cold air channel portions the cold air can effectively be fed to the goods presentation space through openings provided in the goods presentation space rear wall from behind and at the same time a curtain of cold air can be formed.

According to a further embodiment, at the front side of the top portion of the refrigerated sales furniture there is an air curtain opening of the cold air channel for providing a curtain of cold air in front of the goods presentation space that extends between the air curtain opening and the air entry opening of the air suction channel. By such cold air channel the amount of warm air entering into the goods presentation space from the front can be minimized which provides for a highly efficient cooling.

According to a further embodiment, goods presentation shelves are arranged in the goods presentation space, wherein at least one of the goods presentation shelves is an air guiding goods presentation shelf directing cold air from the cold air channel through its bottom to the compartment of the goods presentation space arranged directly below the goods presentation shelf. By such air guiding goods presentation shelf the goods compartment underneath such shelf can be effectively cooled by means of cold airflows coming from above.

According to a further embodiment, the goods presentation shelf arranged on top of the bottom area of the goods presentation space is an air guiding goods presentation shelf for directing cold air from the cold air channel through its bottom to the bottom area of the goods presentation space. Particularly this portion which is conventionally very difficult to cool, can be cooled reliably by forming the goods presentation shelf arranged above it as air guiding goods presentation shelf.

According to a further embodiment, a warm air channel is fluidly connected to the air pressure channel. By such warm air channel a partial airflow which is used to form a curtain of warm air along the front side of the goods presentation space is branched off from the air pressure channel.

According to a further embodiment, the warm air channel comprises a vertical warm air channel portion extending basically parallel to the furniture rear wall and a horizontal warm air channel portion extending basically parallel to an upper furniture wall of the goods presentation space.

According to a further embodiment, the vertical warm air channel portion extends between the furniture rear wall and the vertical cold air channel portion, and wherein the horizontal warm air channel portion extends between the upper furniture wall and the horizontal cold air channel portion.

According to a further embodiment, the horizontal warm air channel portion comprises a warm air curtain opening at the front of the upper furniture wall for providing a curtain of warm air in front of the goods presentation space, that extends between the warm air curtain opening and the air entry opening of the air suction channel.

According to a further embodiment, the warm air curtain opening is arranged in front of the cold air curtain opening so that the curtain of warm air will be positioned before the curtain of cold air. By positioning the curtain of cold air behind the curtain of warm air, a further improved efficiency of the refrigerated sales furniture can be attained.

According to a further embodiment, the bottom area of the goods presentation space is formed as a trough, is configured to accommodate or is equipped with a removable container. By such trough or removable container the goods to be presented and cooled can be supported and presented well.

According to a further embodiment, the bottom area of the goods presentation space is confined by a bumper at its front side. By such a bumper the front side of the refrigerated sales furniture can be protected against scratches and the like.

According to a further embodiment, the bumper is of reduced width so as to provide for a sufficient width of the bottom area of the goods presentation space with the rear air suction channel portion of the air suction channel, the lower air pressure channel portion of the air pressure channel and the lower cold air channel portion of the cold air channel being arranged behind the lower rear wall portion of the perforated goods presentation space rear wall. By such reduced width bumper the available goods presentation space can be maximized.

According to a further embodiment, the bumper is removable.

According to a further embodiment, the fan is of reduced width so as to provide for a sufficient width of the bottom area of the goods presentation space. Such a fan has been developed by the inventors. In particular, the vertical rear air suction channel portion can have a width of 30-150 mm, which also limits the width of the fan, such that the fan can have a width of 30-150 mm.

According to a further embodiment, the rear air suction channel portion of the air suction channel, the lower air pressure channel portion of the air pressure channel and the lower cold air channel portion of the cold air channel are of reduced width so as to provide for a sufficient width of the bottom area of the goods presentation space. In particular the width of the lower cold air channel portion can be made smaller than the widths of the rear air suction channel portion and the lower air pressure channel portion. In particular, the vertical rear air suction channel portion can have a width of 30-150 mm, the lower air pressure channel portion can have a width of 30-100 mm and the lower cold air channel portion can have a width of 3-50 mm.

While the invention has been described with reference to an exemplary embodiment, it will be understood by those skilled in the art that various changes may be made and equivalents may be substituted for elements thereof without departing from the scope of the invention. In addition, modifications may be made to adapt a particular situation or material to the teachings of the invention without departing from the essential scope thereof. Therefore, it is intentended that the invention is not limited to the particular embodiment disclosed, but that the invention will include all embodiments falling within the scope of the appended claims.

LIST OF REFERENCE NUMERALS

2 refrigerated sales furniture
4 base
6 furniture rear wall
8 upper furniture wall
9 upper goods presentation space wall
10 goods presentation space
11*a*, 11*b*, 11*c* upper and middle areas of the goods presentation space
12 bottom area of the goods presentation space
14 goods presentation space bottom wall
15 orifice/nozzle
15*a* opening
15*b* insert element
16 front wall of the cold air channel/goods presentation space rear wall
17 protrusion
18 continuous opening in the lower portion of the goods presentation space rear wall
19 air baffle element
20 air suction channel
21 stopper/detection/marker element
22 air entry opening
24 substantially horizontal air suction channel portion
26 substantially vertical rear air suction channel portion
28 vertical wall
30 fan
32 air pressure channel
34 lower air pressure channel portion
36 upper air pressure channel portion
38 lower section
40 upper section
42 vertical wall
44 bend
46 evaporator
48 cold air channel
50 substantially vertical cold air channel portion
51 upper portion of the cold air channel
52 horizontal cold air channel portion
53 middle portion of the cold air channel
54 lower portion of the cold air channel
56 air curtain opening of the cold air channel
58 curtain of cold air
60 warm air channel
62 vertical warm air channel portion
64 horizontal warm air channel portion
66 warm air curtain opening
68 curtain of warm air
70 goods presentation shelves
72 air guiding goods presentation shelf
76 bumper
80 stopper element
82 spacer rods
84 link for fixing a spacer rod

The invention claimed is:

1. A refrigerated sales furniture comprising:

a base provided at a bottom of the refrigerated sales furniture;

a goods presentation space comprising a front portion allowing access to the goods presentation space and an opposing rear portion;

wherein the goods presentation space includes a bottom area located next to the base; and a cold air channel located next to the rear portion of the goods presentation space comprising a lower portion arranged next to the bottom area of the goods presentation space and having an opening fluidly connecting the lower portion of the cold air channel with the bottom area of the goods presentation space for allowing cold air to flow from the lower portion of the cold air channel into the bottom area of the goods presentation space;

a baffle element for guiding the flow of cold air flowing into the lower portion of the cold air channel, wherein the baffle element comprises a baffle strip arranged at an upper portion of the bottom area of the goods presentation space next to the cold air channel;

wherein the opening is provided as a continuous opening extending over the whole height and width of the bottom area, respectively.

2. The refrigerated sales furniture of claim 1, wherein vertical upper and middle portions of the cold air channel are defined by a front wall and a rear wall, the front wall of the cold air channel forming a rear wall of upper and middle portions of the goods presentation space.

3. The refrigerated sales furniture of claim 2, wherein at least a portion of the front wall of the cold air channel is perforated allowing cold air to flow from the cold air channel into middle and upper portions of the goods presentation space.

4. The refrigerated sales furniture of claim 2, wherein the baffle element is configured for guiding the cold air flowing out of the middle portion of the cold air channel into the lower portion of the cold air channel.

5. The refrigerated sales furniture of claim 1, wherein the baffle element extends over the whole width of the continuous opening.

6. The refrigerated sales furniture of claim 1, comprising a nozzle or orifice configured for guiding cold air flowing in the cold air channel.

7. The refrigerated sales furniture of claim 1, wherein the cross section of the cold air channel is narrowed in the direction of the flow of cold air on top of the opening.

8. A refrigerated sales furniture comprising:

a base provided at a bottom of the refrigerated sales furniture;

a goods presentation space comprising a front portion allowing access to the goods presentation space and an opposing rear portion;

wherein the goods presentation space includes a bottom area located next to the base; and a cold air channel located next to the rear portion of the goods presentation space comprising a vertical lower portion arranged next to the bottom area of the goods presentation space and having an opening fluidly connecting the lower portion of the cold air channel with the bottom area of the goods presentation space for allowing cold air to flow from the vertical lower portion of the cold air channel into the bottom area of the goods presentation space;

wherein the opening is provided as a continuous vertical opening extending over the whole height and width of the bottom area, respectively;

wherein at least one stopper is provided for preventing goods from entering into the vertical lower portion of the cold air channel.

9. The refrigerated sales furniture of claim 8, wherein the at least one stopper is mounted to or formed by a portion of the goods presentation space bottom wall.

10. The refrigerated sales furniture of claim 8, wherein the at least one stopper is mounted to or formed by a portion of the rear wall of the vertical lower portion of the cold air channel.

11. The refrigerated sales furniture of claim 1, further comprising at least one marker for marking the boundary between the vertical lower portion of the cold air channel and the goods presentation space.

12. The refrigerated sales furniture of claim 1, further comprising at least one detector configured for detecting goods which have entered into the vertical lower portion of the cold air channel.

13. The refrigerated sales furniture of claim 12, wherein the detector comprises a light barrier and/or a mechanical contactor.

14. The refrigerated sales furniture of claim 1, wherein the bottom area extends between the base of the refrigerated sales furniture and a goods presentation shelf located on top of the bottom area.

15. A refrigerated sales furniture comprising:

a base provided at a bottom of the refrigerated sales furniture;

a goods presentation space comprising a front portion allowing access to the goods presentation space and an opposing rear portion;

wherein the goods presentation space includes a bottom area located next to the base; and a cold air channel located next to the rear portion of the goods presentation space comprising a vertical lower portion arranged next to the bottom area of the goods presentation space and having an opening fluidly connecting the vertical lower portion of the cold air channel with the bottom area of the goods presentation space for allowing cold air to flow from the lower portion of the cold air channel into the bottom area of the goods presentation space;

wherein the opening is provided as a continuous vertical opening extending over the whole height and width of the bottom area, respectively;

wherein an air pressure channel is provided next the cold air channel opposite to the goods presentation space, wherein at least one heat-exchanger is provided within said air pressure channel;

further comprising an air suction channel for sucking air from a lower front end portion of the refrigerated sales furniture.

16. The refrigerated sales furniture of claim 15, wherein an air pressure channel is provided next the cold air channel opposite to the goods presentation space, wherein at least one heat-exchanger is provided within said air pressure channel.

17. The refrigerated sales furniture of claim 16, wherein the air suction channel has a vertical rear air suction channel portion being arranged at a position behind the bottom area of the goods presentation space and arranged between a furniture rear wall and a lower portion of the air pressure channel.

18. The refrigerated sales furniture of claim 15 further comprising a fan which is configured for delivering ambient air from the air suction channel into the air pressure channel.

* * * * *